US006908247B2

(12) United States Patent
Gomez

(10) Patent No.: US 6,908,247 B2
(45) Date of Patent: Jun. 21, 2005

(54) GOLF BALL CLEANING APPARATUS

(76) Inventor: David P. Gomez, 6001 Sedgley Ct., Burr Ridge, IL (US) 60521

( * ) Notice: Subject to any disclaimer, the term of this patent is extended or adjusted under 35 U.S.C. 154(b) by 0 days.

(21) Appl. No.: 10/851,993

(22) Filed: May 21, 2004

(65) Prior Publication Data

US 2005/0031402 A1 Feb. 10, 2005

Related U.S. Application Data

(60) Provisional application No. 60/472,997, filed on May 23, 2003.

(51) Int. Cl.[7] ..... A45D 33/00

(52) U.S. Cl. ..... 401/130; 401/6; 401/9; 401/118; 401/207; 15/104.92; 15/104.94; D3/225; D3/257

(58) Field of Search ..... 401/6, 9, 118, 126, 401/127, 130, 207; 15/104.92–104.94, 244.1, 15/244.4; D3/225, 257

(56) References Cited

U.S. PATENT DOCUMENTS

| | | | | |
|---|---|---|---|---|
| 1,820,256 | A | 8/1931 | Stewart | |
| 4,974,763 | A | 12/1990 | Widrig | |
| 5,131,112 | A | 7/1992 | Cervini | |
| D366,685 | S | 1/1996 | Faulk | |
| 5,524,311 | A | 6/1996 | Crossley | |
| 5,572,761 | A * | 11/1996 | Meyer | 15/104.92 |
| 5,638,567 | A | 6/1997 | Danyluk | |
| 5,641,232 | A | 6/1997 | Frey | |
| 5,829,086 | A | 11/1998 | Billek | |
| 6,036,386 | A | 3/2000 | McDonald | |
| 6,148,464 | A | 11/2000 | Shioda | |
| 6,379,066 | B1 * | 4/2002 | Gomez | 401/6 |

* cited by examiner

*Primary Examiner*—Tuan Nguyen
(74) *Attorney, Agent, or Firm*—Holland & Knight LLP

(57) ABSTRACT

The present invention relates to a golf ball cleaning apparatus that is adapted to be worn on the belt of a user. The apparatus permits its wearer to easily clean a golf ball at any point during a round of golf. The apparatus includes a water tight container with a slidable tray storing a sponge. A serrated edge is also included upon the tray to remove build-up upon a golf ball.

6 Claims, 5 Drawing Sheets

FIG 5
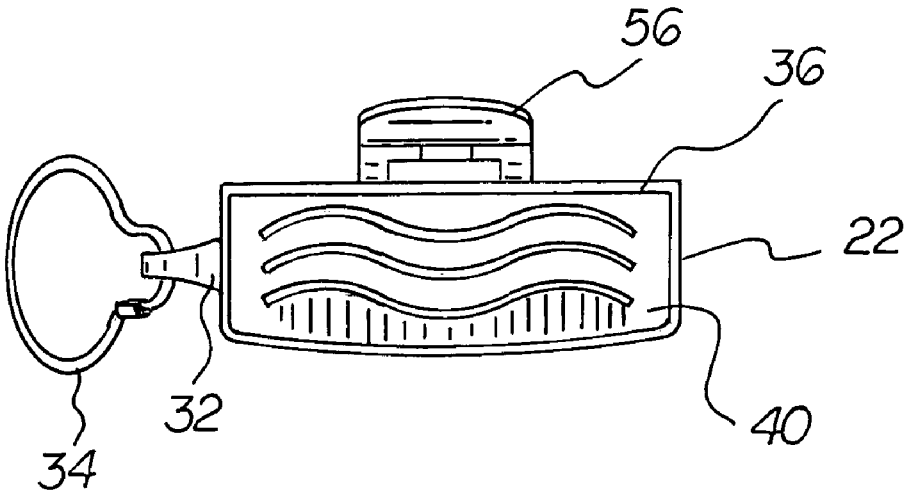
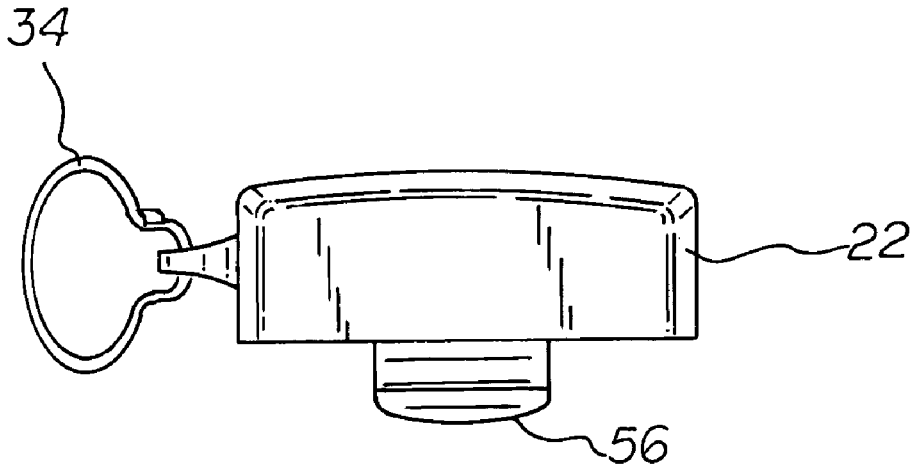
FIG 6

GOLF BALL CLEANING APPARATUS

RELATED APPLICATION DATA

This application claims benefit of provisional patent application Ser. No. 60/472,997 filed May 23, 2003 entitled "Golf Ball Cleaning Apparatus."

BACKGROUND OF THE INVENTION

1. Field of the Invention

This invention relates to a portable golf ball cleaning device. More particularly, the present invention relates to a belt worn container housing a sponge that is specifically adapted to clean the surface of a golf ball.

2. Description of the Background Art

The use of golf ball cleaners is known in the art. Such cleaners typically include a housing retaining a volume of fluid. The housing is mounted upon a post embedded within the ground. These golf ball cleaning devices are positioned at various locations around a golf course to allow users to clean their golf balls during a game of golf. However, such cleaning devices suffer a draw back insomuch as they are stationary. Consequently, users can wash their golf balls only at particular times and locations throughout the course of a golf game. As any golfer knows, golf balls become dirty and soiled at various times during a round of golf—not just when a player has access to a ball washer. To remedy this, portable golf ball washers have been developed.

For example, U.S. Pat. No. 5,641,232 to Frey discloses a portable ball washer that includes a fluid reservoir within a sealed housing and a concave portion that contains a moisture retaining paid.

U.S. Pat. No. 6,148,464 to Shioda discloses a golf ball cleaning device including a ball cleaning pad of a water absorbent material and a waterproof backing that is attachable to a golfer and that can be used for wiping a ball.

Commonly owned U.S. Pat. No. 6,379,066 to Gomez discloses a golf ball cleaning apparatus that includes a water tight container with a hinged lid that stores a cleaning implement.

Despite the presence of these designs, there exists a need in the art for a portable golf ball washer that allows users to clean their golf balls in an easy and effective manner.

It is therefore an object of the present invention to provide a portable golf ball washer that stores a volume of cleaning fluid in a spill-proof manner and that is not susceptible to leaking.

It is another object of the present invention to provide a user manipulable cleaning implement that can be used without a user getting cleaning fluid on their hands.

SUMMARY OF THE INVENTION

For the purpose of summarizing this invention, the invention comprises a golf ball cleaning apparatus that is adapted for use while playing a game of golf. The apparatus includes a rectangular container within which a supply of cleaning fluid can be stored. A drawer housing a sponge is adapted to slide in and out of the container. The drawer includes a lower surface that is moistened with a commercial cleaning fluid. A serrated edge can also be included to remove any spots. The apparatus further includes golf tee holders on one side for receiving and storing extra golf tees. On the opposite side, a towel holder can be included. A handle is attached to the upper surface of the drawer or tray.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5 is a top plan view of the cleaning apparatus of the present invention.

FIG. 6 is a bottom plan view of the cleaning apparatus of the present invention.

Similar reference characters refer to similar parts throughout the several views of the drawings.

DETAILED DESCRIPTION OF THE PREFERRED EMBODIMENT

Figure 1:
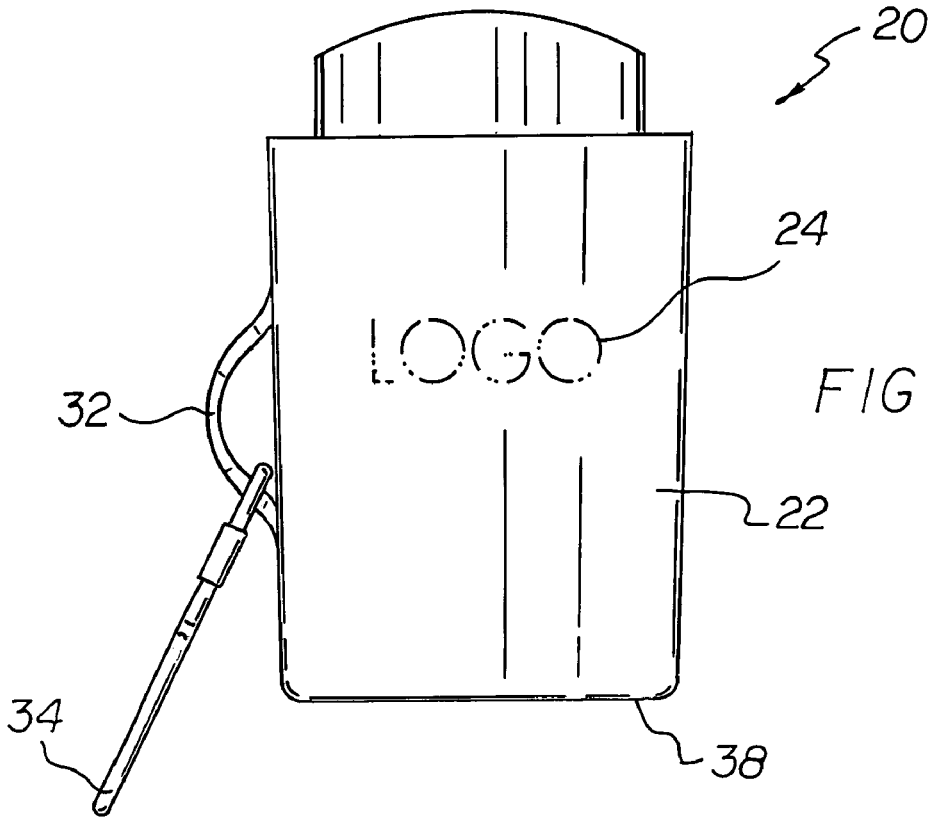
FIG. 1 is a front elevational view of the golf ball cleaning apparatus of the present invention.
Figure 2:
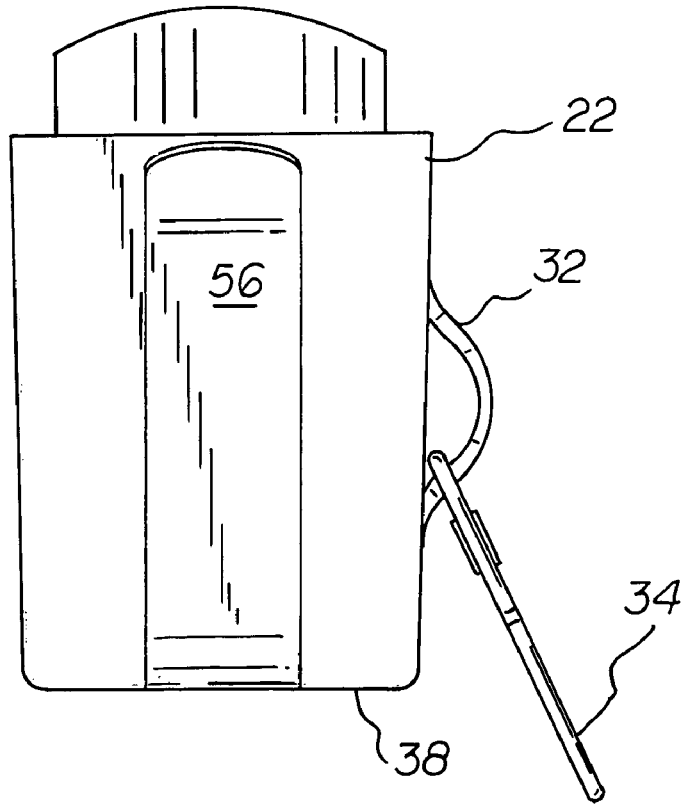
FIG. 2 is a rear elevational view of the golf ball cleaning apparatus of the present invention.
Figure 3:
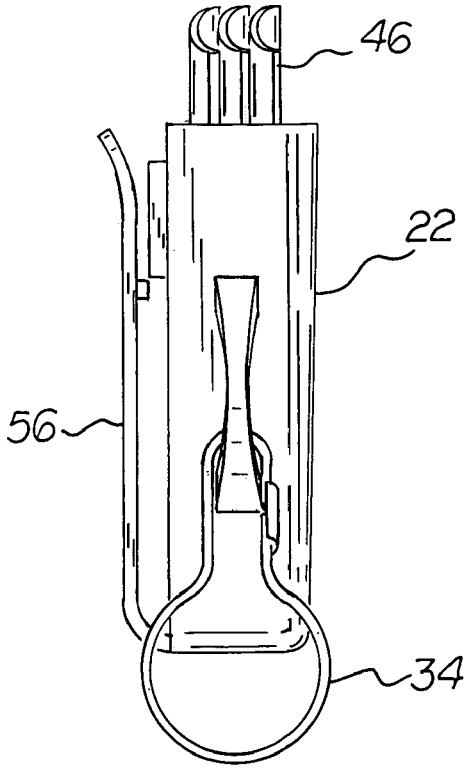
FIG. 3 is a side view of the cleaning apparatus of the present invention.

The present invention relates to a golf ball cleaning apparatus that is meant to be worn on the belt of the user during a round of golf. The apparatus allows a golfer to clean a golf ball without having to locate a stationary golf ball washer.

The major component of the cleaning apparatus 20 is the container 22. The container is principally formed from an impact resistant plastic. The container 22 is water tight and contains a small amount of a cleaning fluid, such as soap and water. The external surface of the container can be colored or it can otherwise bear indicia such as a logo 24. In this manner, the apparatus 20 of the present invention can be used as a marketing device. On the opposite side of container 22 an integrally molded loop 32 is formed. This loop can be used to retain a towel holder 34.

The opened upper end 36 of container 22 is adapted to receive tray 42. Tray 42 is retained within the container insomuch as the lower end of the container 38 is closed. Tray 42 is adapted to hold a sponge 44. The tray further includes a handle 46 to facilitate placement of tray 42 within container 22. A container lid 40 is also included upon the tray 42. The lid 40 seals and is flush with the opened upper end 36 of the container 22 when the tray 42 is in a closed orientation. In the preferred embodiment, the handle 46 is curved to facilitate placement of a user's thumb and forefinger. The side edges 48 of tray 42 are curved and operate to retain sponge 44 within tray 42, but nonetheless permit sponge 44 to be removed when needed. The tray is open-faced, thereby allowing the supplied fluid to soak into the sponge 44 when tray 42 is enclosed within container 22.

Figure 4:
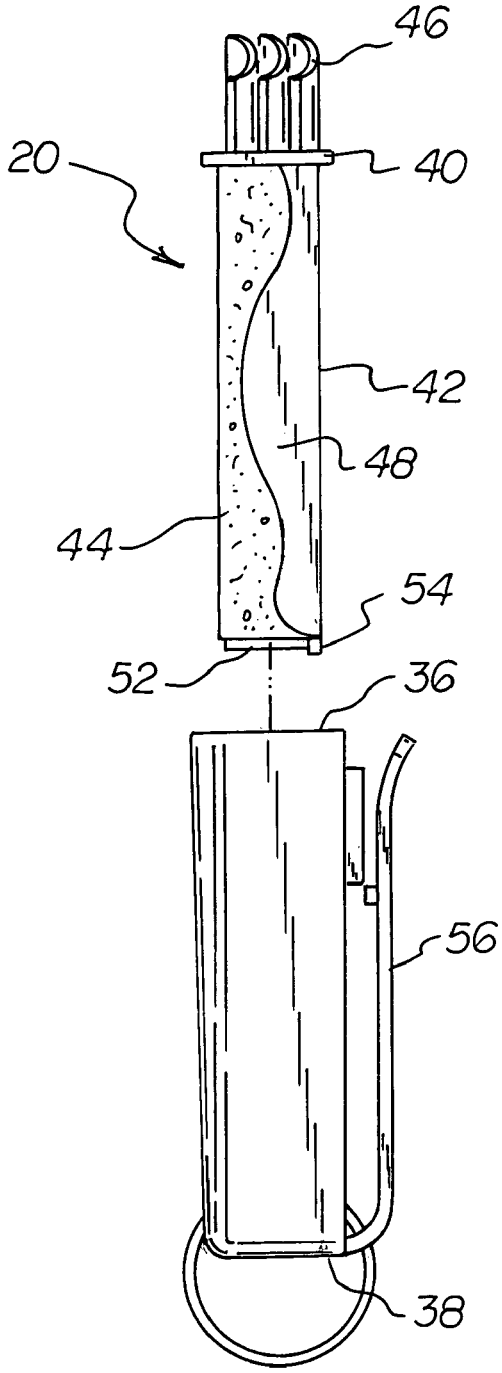
FIG. 4 is another side view of the cleaning apparatus with the cleaning tray removed.
Figure 7:
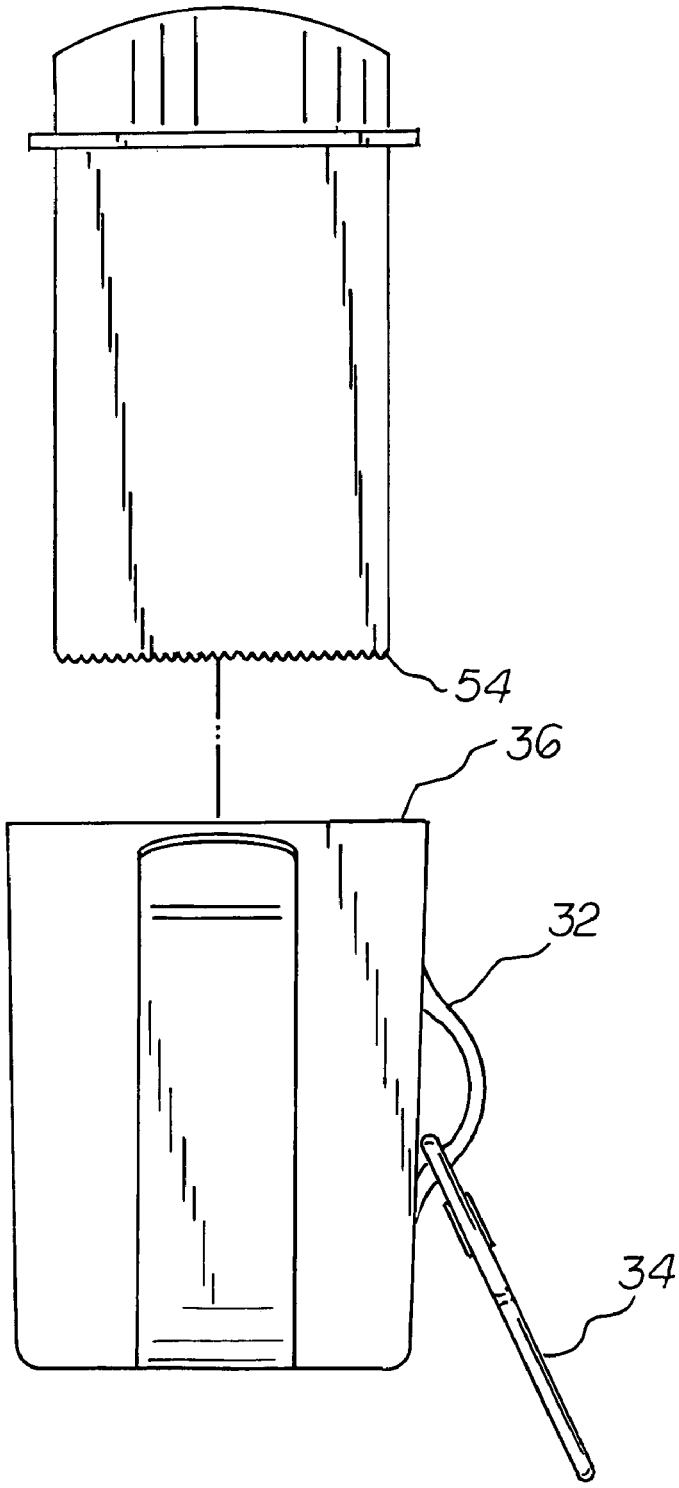
FIG. 7 is a rear elevational view of the cleaning apparatus with the tray removed.

The lower edge of the tray 42 is depicted in FIG. 4. Specifically, the lower edge of tray 42 has a block of cleaning material 52, such as a hardened abrasive material, secured thereto. Alternatively, this may be an additional sponge-like material containing a supply of cleaning fluid. It is also within the scope of the present invention to employ a tray without an additional cleaning material. In operation, the tray 42 can be removed from container 22, and used as an implement to apply cleaning material 52 to the surface of a ball. Thereafter, the ball can be wiped with the surface of sponge 44. In an additional embodiment, a serrated edge 54 is included to remove any build-up that may have accumulated on the golf ball.

Finally, the entire apparatus 20 is adapted to be worn on the belt by the user by way of a belt loop or clip 56. This belt loop 56 is preferably spring biased to the closed orientation and can be pivoted to an open position and inserted over a user's belt.

Figure 8:
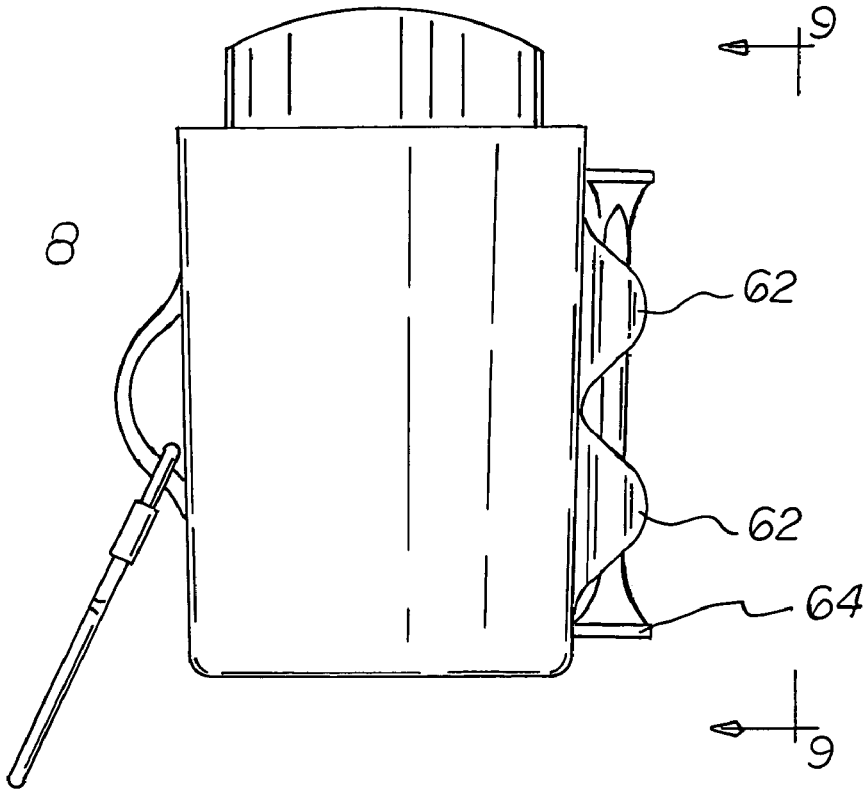
FIG. 8 is an elevational view of an alternative embodiment of the present invention.
Figure 9:
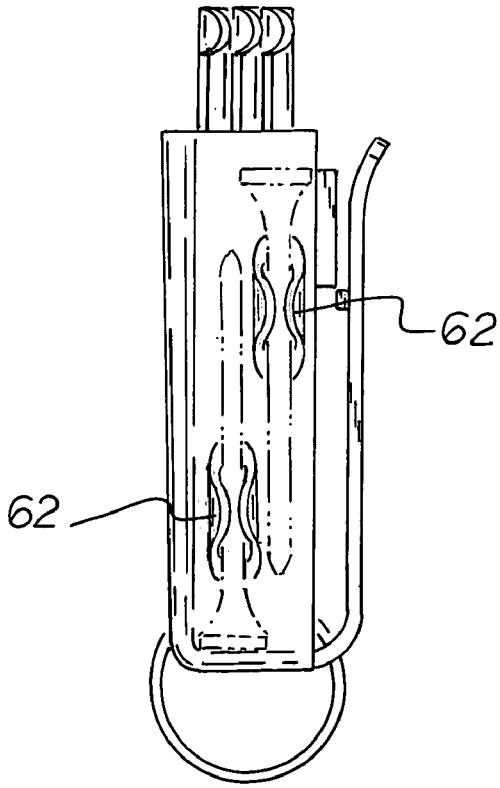
FIG. 9 is a side elevational view of an alternative embodiment of the present invention.

An alternative embodiment of the invention is depicted in FIGS. 8 and 9. This embodiment is the same as the embodiment of FIGS. 1–7, except that it includes tee holders 62 that are integrally formed with the container. The tee holders hold one or more golf tees 64 in a friction fit manner.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A portable golf ball cleaning device comprising in combination:

a container formed from rigid plastic material and retaining a volume of cleaning fluid, the container having an opened top, a closed bottom, forward and rearward faces, and inwardly tapering sidewalls, a loop integral with one of the tapering sidewalls, the loop functioning in retaining a towel;

a tray having a first end with a container lid and an arcuate handle, the tray further including curved side walls and a second end of a hardened abrasive material and a serrated edge, a sponge removably positioned within the tray, the tray being slidably positioned within the container such that the sponge can absorb cleaning fluid, the tray having a completely stored orientation wherein the tray is positioned within the container and the container lid seals and is flush with the opened top of the container, the tray being removable from the container such that the sponge can be used to clean the golf ball and the abrasive material and serrated edge can be used to break-up hardened soils;

a spring biased belt clip secured to the rearward face of the container, the belt clip enabling the device to be worm by a golfer;

a logo printed upon the forward face of the container.

2. A portable golf ball cleaning device comprising in combination:

a container retaining a volume of cleaning fluid, the container having an opened top, a closed bottom, forward and rearward faces, and sidewalls;

a tray having a first end with a container lid and handle, the tray further including side walls and a second end, a cleaning material removably positioned within the tray, the tray being slidably positioned within the container such that the cleaning material can absorb cleaning fluid, the tray having a completely stored orientation wherein the tray is positioned within the container and the container lid seals the opened top of the container, the tray being removable such that the cleaning material can be employed in cleaning a golf ball.

3. The portable golf ball cleaning device as described in claim 2 wherein the tray includes a hardened cleaning implement at the second end.

4. The portable golf ball cleaning device as described in claim 2 wherein the device includes a clip for retaining the device upon the belt of a wearer.

5. The portable golf ball cleaning device as described in claim 2 wherein the cleaning material is a sponge.

6. The portable golf ball cleaning device as described in claim 2 wherein the tray includes a serrated edge.

* * * * *